US011987437B1

(12) United States Patent
Johnston

(10) Patent No.: US 11,987,437 B1
(45) Date of Patent: May 21, 2024

(54) ATTACHABLE BEVERAGE INSULATOR

(71) Applicant: Slade Johnston, Tuscaloosa, AL (US)

(72) Inventor: Slade Johnston, Tuscaloosa, AL (US)

(73) Assignee: Cooler Comrade LLC, Ward, AL (US)

( * ) Notice: Subject to any disclaimer, the term of this patent is extended or adjusted under 35 U.S.C. 154(b) by 0 days.

(21) Appl. No.: 16/236,958

(22) Filed: Dec. 31, 2018

Related U.S. Application Data

(60) Provisional application No. 62/612,894, filed on Jan. 2, 2018.

(51) Int. Cl.
*B65D 81/38* (2006.01)
*B65D 25/20* (2006.01)
*B65D 25/22* (2006.01)

(52) U.S. Cl.
CPC ..... *B65D 81/3876* (2013.01); *B65D 25/205* (2013.01); *B65D 25/22* (2013.01)

(58) Field of Classification Search
CPC ..... B65D 81/3876; B65D 81/3879
USPC ..... 220/737, 738, 739
See application file for complete search history.

(56) References Cited

U.S. PATENT DOCUMENTS 6,654,553 B2 12/2003 Beuke
6,991,505 B1 1/2006 Wells
7,111,753 B2 9/2006 Sheetz, II et al.
7,685,908 B1 3/2010 Sebastian et al.
8,002,143 B2 8/2011 Vorderkunz
D701,079 S 3/2014 Arora
9,248,939 B2 2/2016 O'Brien
D829,057 S * 9/2018 Agado ..... D7/624.2
2011/0192859 A1* 8/2011 Belford ..... B65D 81/3876 220/739
2012/0132657 A1* 5/2012 Seiders ..... B65D 81/3816 220/592.2
2013/0126686 A1* 5/2013 Ballou ..... A47G 23/0225 248/205.2
2014/0131372 A1* 5/2014 Hiner ..... B65D 23/104 220/739
2014/0339244 A1* 11/2014 Arnold ..... B65D 81/3886 220/739
2017/0225871 A1 8/2017 Jody

* cited by examiner

*Primary Examiner* — Jeffrey R Allen

(57) ABSTRACT

A beverage insulator includes a first portion adapted to insulate a first surface of beverage container, and an attachment point arranged to attach the beverage insulator to an apparatus when the beverage insulator is not in use. The attachment point may include a slit that is adapted to stretch over the handle of a cooler, thereby attaching the beverage insulator to the cooler. The beverage insulator may be adapted to remain substantially flat when attached to the cooler, thereby providing an area for branding or other display.

3 Claims, 15 Drawing Sheets

ATTACHABLE BEVERAGE INSULATOR

CROSS-REFERENCE TO RELATED APPLICATIONS

This application claims priority from U.S. Provisional Patent Application Ser. No. 62/612,894 filed Jan. 2, 2018 which is incorporated by reference.

TECHNICAL FIELD

The inventive principles of this patent disclosure relate generally to beverage and cooler accessories, and more particularly to beverage insulators that can be attached to the handle of a cooler or other suitable apparatus for storage, transit and display.

SUMMARY

Some of the inventive principles of this patent disclosure relate to a beverage insulator including a first portion adapted to insulate a first surface of beverage container, and an attachment point arranged to attach the beverage insulator to an apparatus when the beverage insulator is not in use. The beverage insulator may further include a second portion adapted to insulate a second surface of the beverage container. The attachment point may be disposed on the second portion. The attachment point may include a slit. The first portion may include a sleeve. The first portion may be arranged to remain substantially flat when not in use. The first portion may include a display area.

Some additional inventive principles of this patent disclosure relate to a beverage sleeve including a side portion adapted to wrap around a beverage container, a bottom portion adapted to insulate the bottom of the beverage container, and an attachment point adapted to attach the beverage insulator to an apparatus when the beverage sleeve is not in use. The attachment point may include an opening in the bottom portion. The opening may include a slit.

A reinforcing material may be disposed around the slit. The reinforcing material may include embroidery thread. The side portion may be adapted to remain substantially flat when attached to the apparatus. The side portion may include a display area.

Some additional inventive principles of this patent disclosure relate to a method including insulating a beverage with a beverage insulator, and attaching the beverage insulator to an apparatus when the beverage insulator is not in use. Attaching the beverage insulator to the apparatus may include inserting a portion of the apparatus through an opening in the beverage insulator. The appartus may include a T-shaped handle of a cooler, and the portion of the apparatus inserted through the opening may include a crossbar of the T-shaped handle. The opening in the beverage insulator may include a slit. The beverage insulator may include a beverage sleeve and the slit may be located in a bottom portion of the beverage sleeve.

DETAILED DESCRIPTION

A beverage sleeve, sometimes referred to as a cozy, coozy, or koozie, is a type of beverage insulator that is typically a fabric or foam sleeve and is designed to thermally insulate a beverage container, like a can or bottle. Currently available koozies are not designed to attach to cooler handles for storage. Not having this capability requires the beverage sleeve to be carried separately when not in use. The inventive principles of this patent disclosure enable a beverage sleeve to be attached to the handle of a cooler or other suitable apparatus for storage, transit and display.

A majority of currently available rotomolded coolers use the same T-shaped handles to secure the top of the cooler to the bottom of the cooler. A beverage sleeve fabricated according to the inventive principles of this patent disclosure is particularly well suited to use with these types of handles.

The inventive principles of this patent disclosure also enable a beverage sleeve to serve as a platform for branding when attached to the handle of a cooler or other suitable apparatus. Although some example embodiments are described below in context of beverage sleeves and specific handle types, the inventive principles apply to other types of beverage insulators, handles, and other attachment apparatus and techniques.

Some of the inventive principles of this patent disclosure relate to the attachability of a thermally insulating beverage jacket to a handle or other suitable apparatus, especially a handle of a rotomolded cooler. This may be accomplished, for example, with a slit or other opening in the bottom of the beverage jacket that allows it to fit, preferably tightly, around one of the cooler's handles.

Figure 1:
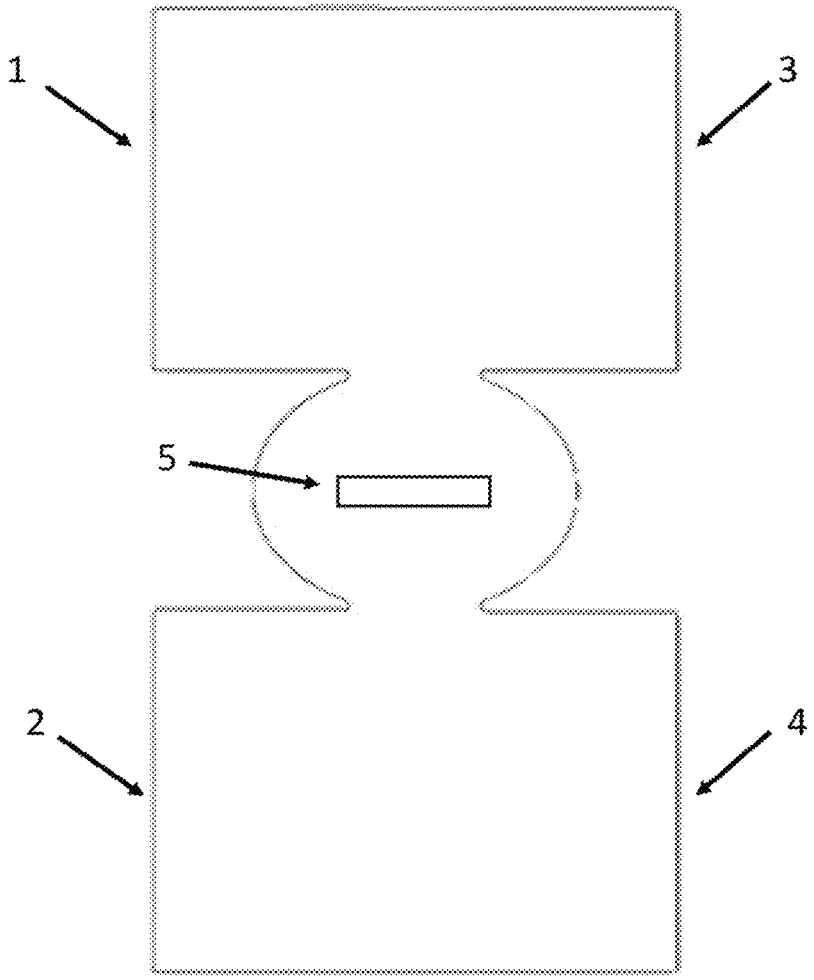
FIG. 1 is a diagram of a flattened piece of material that can be formed into an embodiment of a beverage sleeve according to some inventive principles of this patent disclosure.

FIG. 1 is a diagram of a flattened piece of material that can be formed into an embodiment of a beverage sleeve according to some inventive principles of this patent disclosure. Referring to FIG. 1, side 1 is most commonly sewed to side 2. Side 3 is also most commonly sewed to side 4. The connecting of these sides creates a shape that is typical of a conventional beverage sleeve. The sleeve may be made of a thermally insulating material. More specifically, in a preferred embodiment the thermally insulating material may be neoprene in order to keep the beverage cold and/or prevent excessive moisture buildup while still being flexible enough to allow the bottom/slit to stretch as described below. Alternatively, the sleeve may be made of any suitable material that suits the purposes of flexibility and thermal insulation in order to accommodate and thermally insulate a beverage container. In alternate embodiments, the sleeve may use leather or wool for the material to provide thermal insulation.

Referring again to FIG. 1, location 5 indicates one possible location for a slit in the bottom of the sleeve to provide attachability to cooler handles.

Figure 2:
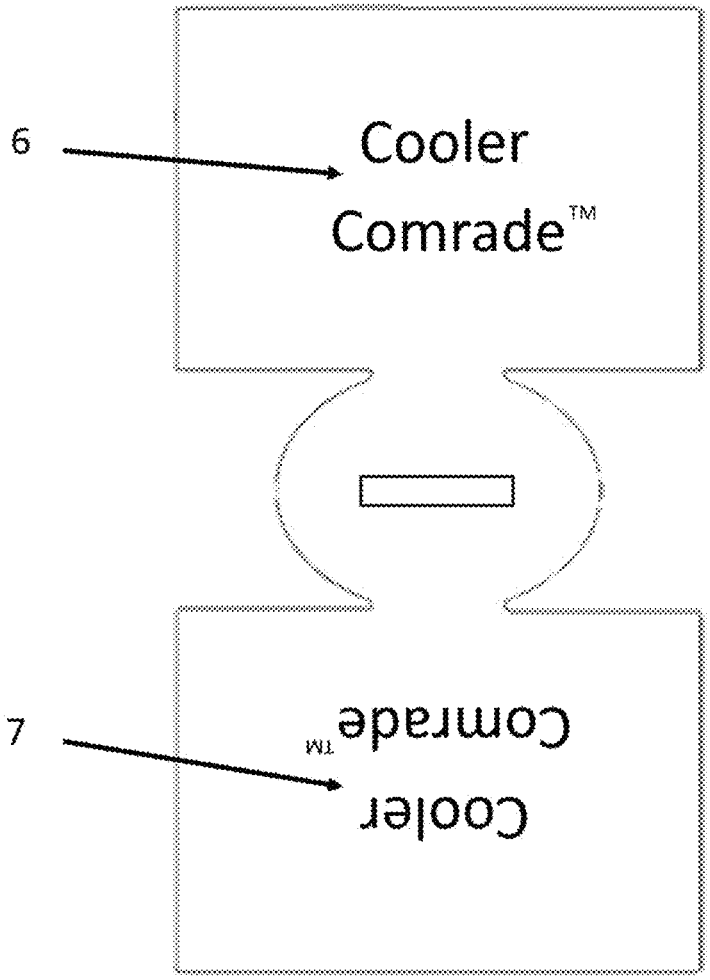
FIG. 2 is a diagram of a flattened piece of material that can be formed into an embodiment of a beverage sleeve and showing branding according to some inventive principles of this patent disclosure.

FIG. 2 is another diagram of the flattened piece of material of FIG. 2 showing some possible locations for branding according to some inventive principles of this patent disclosure. Referring to FIG. 2, portion 6 and portion 7 illustrate possible locations for branding or other types of displays that may be placed on the beverage sleeve.

Figure 3:
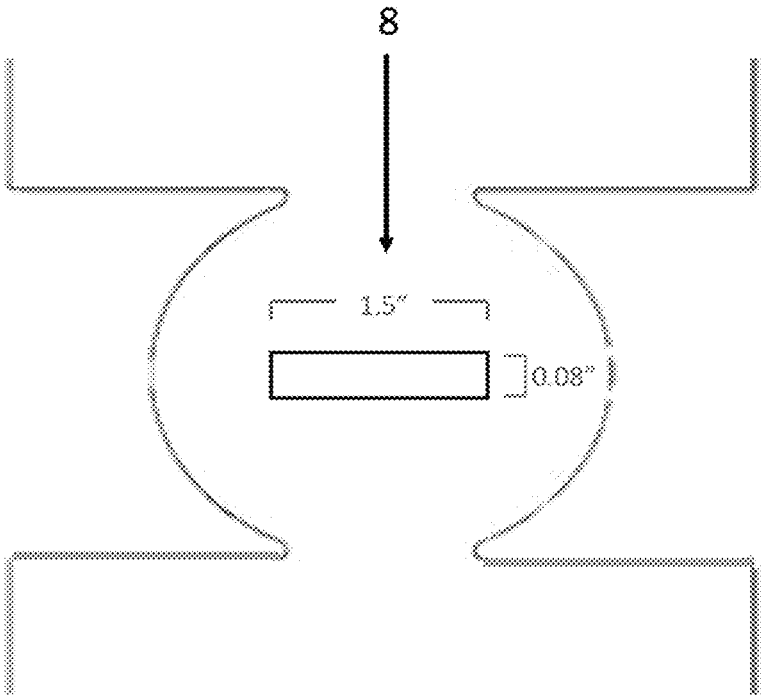
FIG. 3 is a cropped diagram of a flattened piece of material of FIG. 1 or 2 showing some example dimensions for a slit in the bottom of the sleeve according to some inventive principles of this patent disclosure.

FIG. 3 is a cropped diagram of a flattened piece of material of FIG. 1 or 2 showing some example dimensions for a slit in the bottom of the sleeve according to some inventive principles of this patent disclosure. Referring to FIG. 3, a slot at location 8 is generally 1.5 inches in length and 0.08 inches in width. These measurements could be longer or shorter in production depending on the specific size and/or shape of the handle or other apparatus to which the sleeve is intended to be attached. In this embodiment, the slit is located in the center of the bottom portion of the koozie and aligned with the seems so that the koozie lays flat relative to the cooler to take up minimal space and provide a branding platform when attached to a handle of the cooler. The slit at location 8 may generally have sewn edges and be arranged in a rectangle shape to prevent tearing when putting on and taking off the cooler handle. Any other suitable technique or material such as heat transfer vinyl may be used to reinforce and/or provide support for the slit or other opening.

Figure 4:
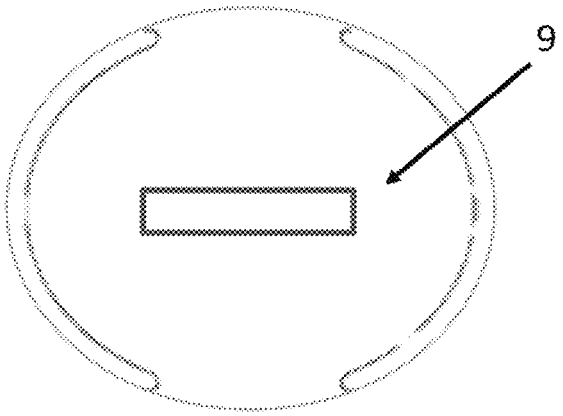
FIG. 4 illustrates the bottom of an embodiment of a beverage sleeve that has been sewn completely according to some inventive principles of this patent disclosure.

FIG. 4 illustrates the bottom of an embodiment of a beverage sleeve that has been sewn completely according to some inventive principles of this patent disclosure. Referring to FIG. 4, location 9 shows the location of a slit from the bottom of the sleeve in a completely assembled embodiment.

Figure 5:
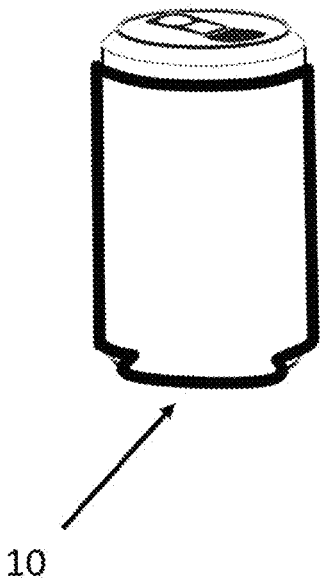
FIG. 5 illustrates an embodiment of a beverage sleeve according to some inventive principles of this patent disclosure with a beverage can inserted into the sleeve.

FIG. 5 illustrates an embodiment of a beverage sleeve according to some inventive principles of this patent disclosure with a beverage can inserted into the sleeve. Referring to FIG. 5, location 10 represents the position of a beverage sleeve given a side view of the sleeve completely assembled. This embodiment allows the sleeve to hold a can or bottle beverage.

Figure 6:
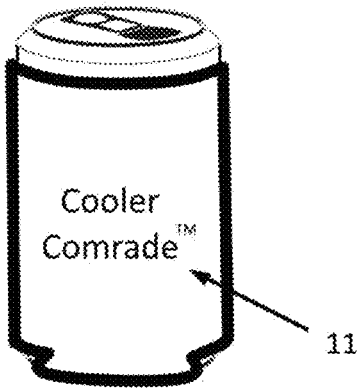
FIG. 6 illustrates an embodiment of a beverage sleeve showing branding according to some inventive principles of this patent disclosure with a beverage can inserted into the sleeve.

FIG. 6 illustrates an embodiment of a beverage sleeve showing branding according to some inventive principles of this patent disclosure with a beverage can inserted into the sleeve. Referring to FIG. 6, location 11 represents a possible location of branding or other type of display that may be applied to the beverage sleeve.

Figure 7:
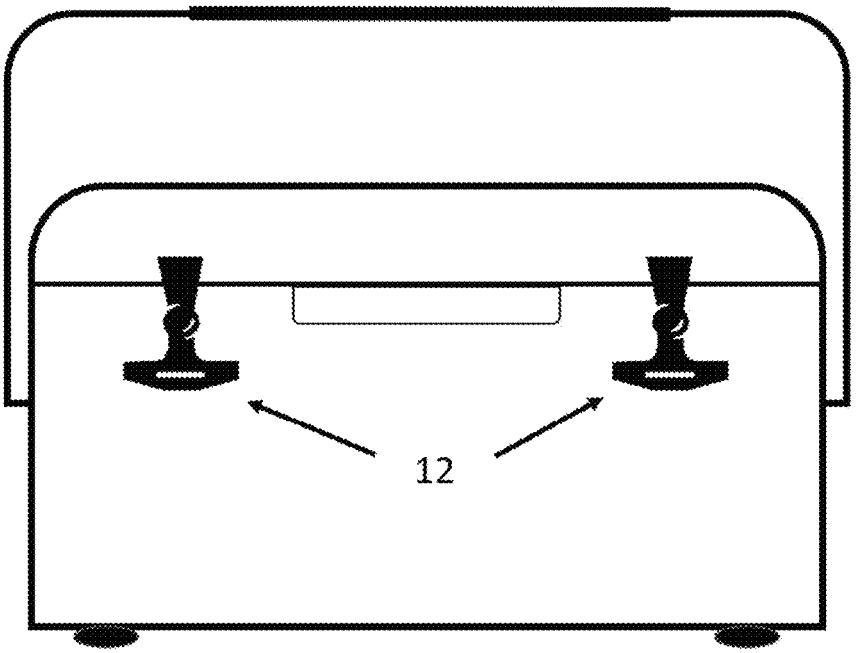
FIG. 7 is a diagram showing the side of a typical currently available rotomolded cooler.

FIG. 7 is a diagram showing the side of a typical currently available rotomolded cooler. Referring to FIG. 7, portion 12 displays the location of handles used on typical currently available rotomolded coolers.

Figure 8:
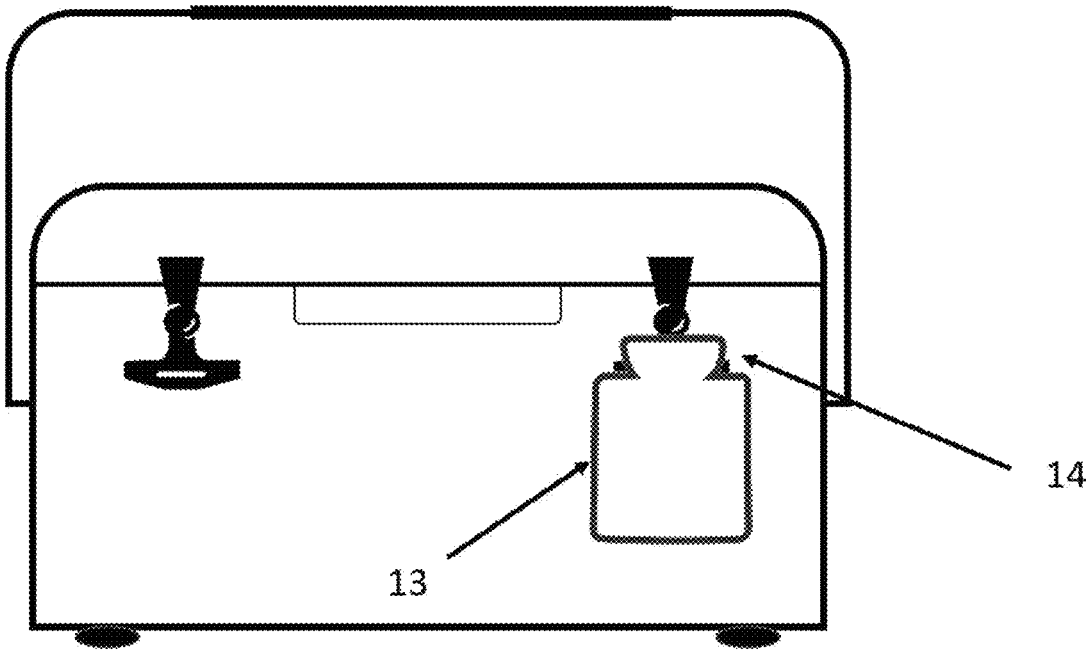
FIG. 8 is a diagram showing the side of a typical currently available rotomolded cooler with an embodiment of beverage sleeve according to some inventive principles of this patent disclosure attached to one handle of the cooler.
Figure 14:
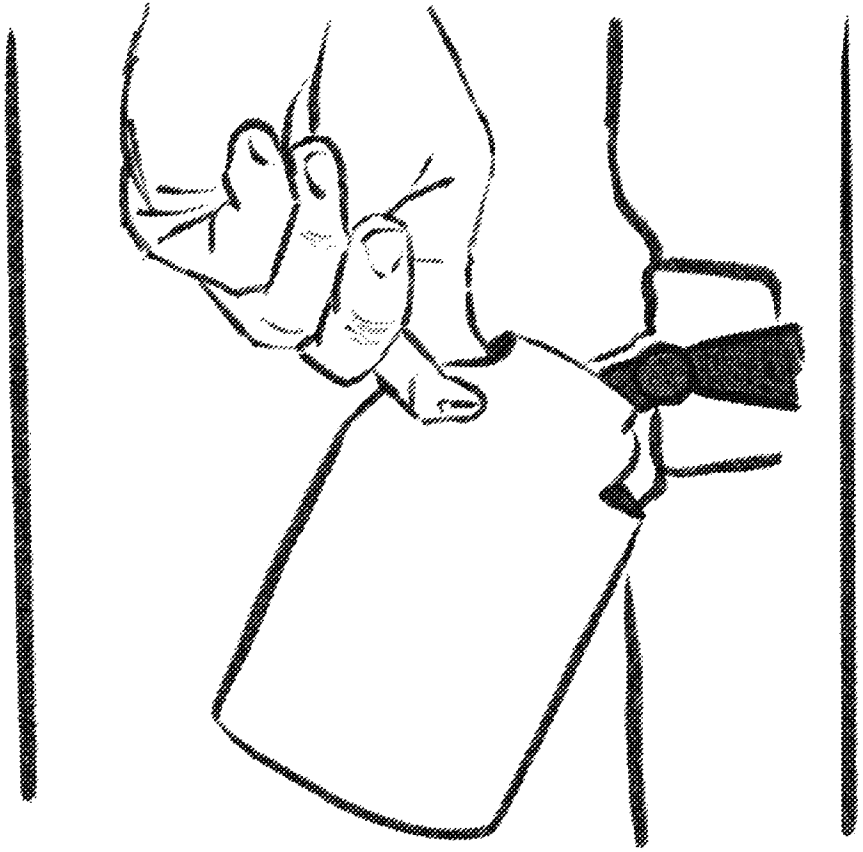
FIG. 14 illustrates how a slit in the bottom of an embodiment of beverage sleeve may be streteched over the crossbar of a handle according to some inventive principles of this patent disclosure.

FIG. 8 is a diagram showing the side of a typical currently available rotomolded cooler with an embodiment of beverage sleeve according to some inventive principles of this patent disclosure attached to one handle of the cooler. Referring to FIG. 8, portion 13 represents the sleeve turned upside down and lying flat relative to the cooler. Referring to FIG. 8, location 14 represents the sleeve attached to the handle of the cooler. A user may attach the sleeve to the handle by inserting one end of the cooler handle crossbar into the slit in the bottom of the sleeve and then pulling the sleeve to stretch the opening over the other end of the handle crossbar as shown in FIG. 14. The sleeve is then released and allowed to relax such that the bottom portion wraps around crossbar and fits snug around the handle while lying flat to the cooler. This provides storage when the sleeve is not in use to prevent having to carry the sleeve separately.

Figure 9:
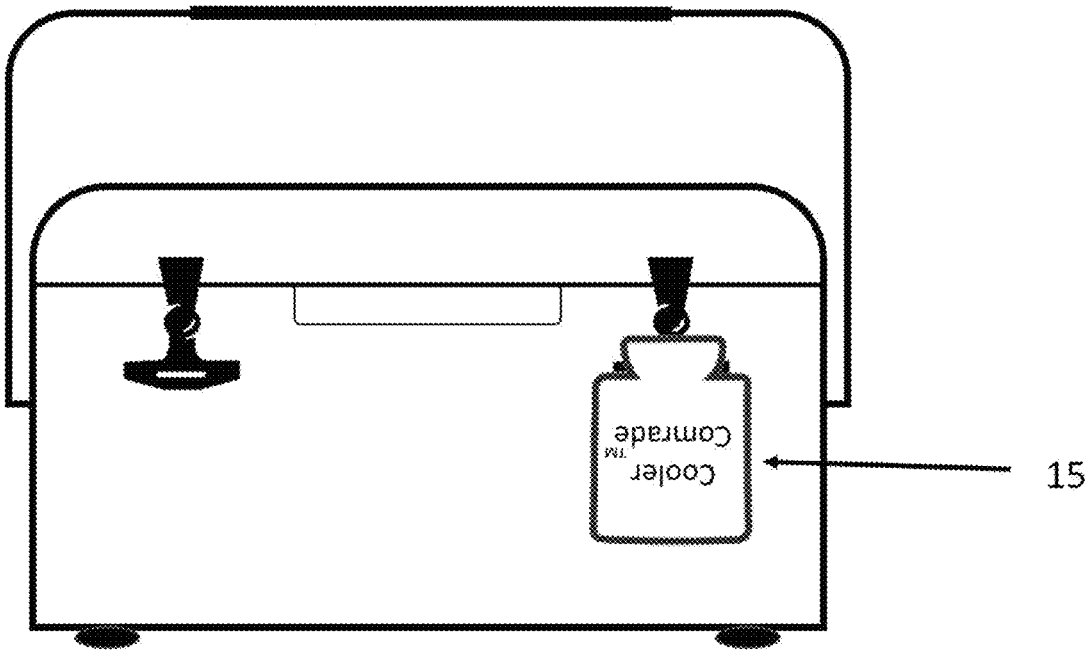
FIG. 9 is a diagram showing the side of a typical currently available rotomolded cooler with an embodiment of beverage sleeve showing branding according to some inventive principles of this patent disclosure attached to one handle of the cooler.

FIG. 9 is a diagram showing the side of a typical currently available rotomolded cooler with an embodiment of beverage sleeve showing branding according to some inventive principles of this patent disclosure attached to one handle of the cooler. Referring to FIG. 9, portion 15 provides an additional representation of the ability for a sleeve to have a display for branding, advertising, warning or other purposes.

Figure 10:
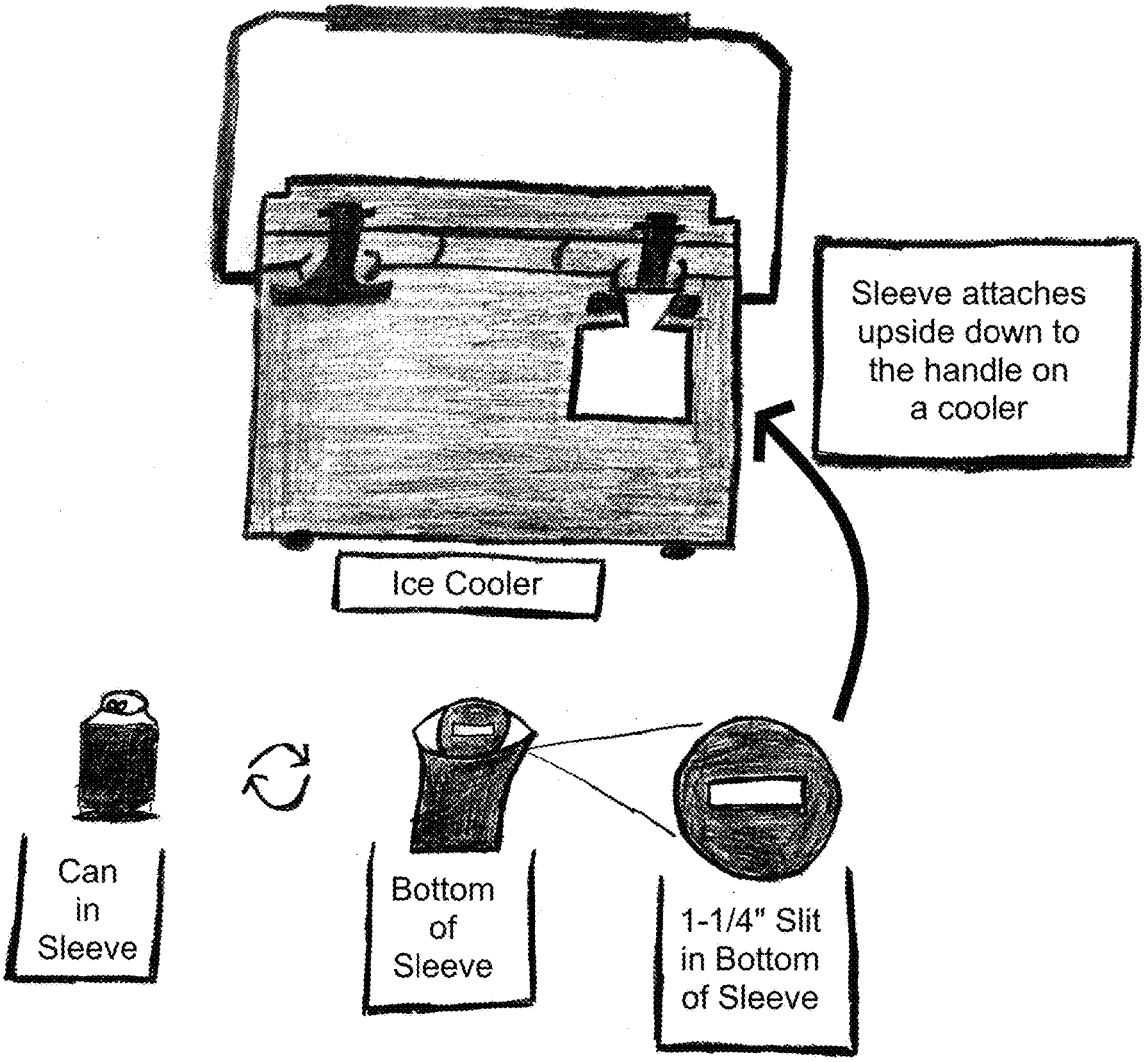
FIG. 10 is a diagram showing the side of a typical currently available rotomolded cooler with an embodiment of beverage sleeve according to some inventive principles of this patent disclosure attached to one handle of the cooler, and further illustrating some additional implementation details according to some inventive principles of this patent disclosure.

FIG. 10 is a diagram showing the side of a typical currently available rotomolded cooler with an embodiment of beverage sleeve according to some inventive principles of this patent disclosure attached to one handle of the cooler, and further illustrating some additional implementation details according to some inventive principles of this patent disclosure.

Figure 11:
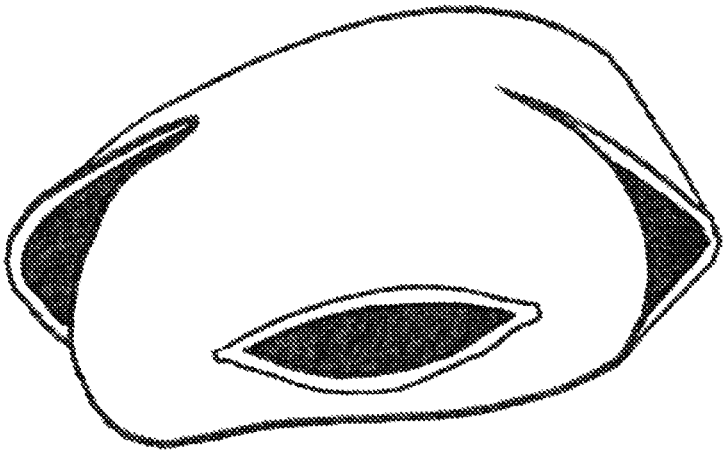
FIG. 11 illustrates the bottom of an embodiment of beverage sleeve according to some inventive principles of this patent disclosure.

FIG. 11 illustrates the bottom of an embodiment of beverage sleeve according to some inventive principles of this patent disclosure. In the view of FIG. 11, the sides of the sleeve are shown collapsed in a substantially flat configuration which causes the bottom to bend a partially open the slit.

Figure 12:
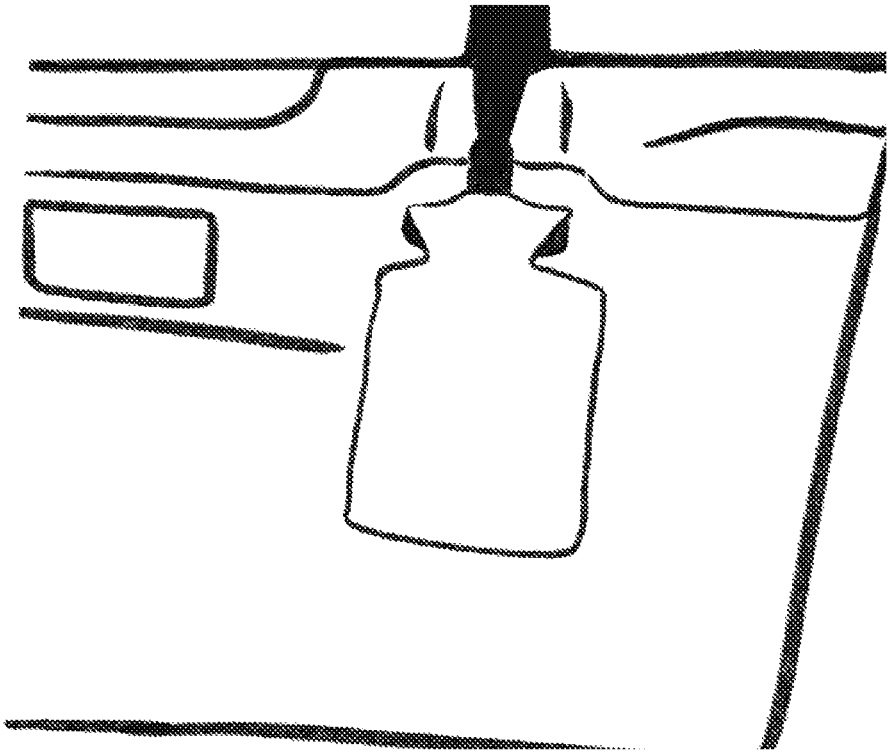
FIG. 12 is another view showing the side of a typical currently available rotomolded cooler with an embodiment of beverage sleeve showing branding according to some inventive principles of this patent disclosure attached to one handle of the cooler.

FIG. 12 is another view showing the side of a typical currently available rotomolded cooler with an embodiment of beverage sleeve showing branding according to some inventive principles of this patent disclosure attached to one handle of the cooler.

Figure 13:
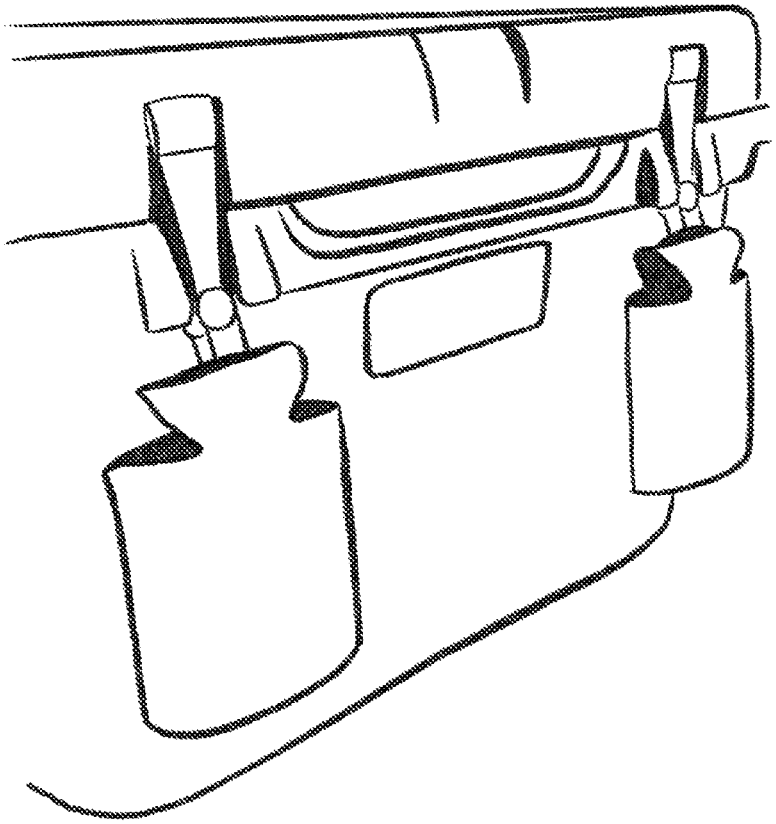
FIG. 13 is another view showing the side of a typical currently available rotomolded cooler with embodiments of two beverage sleeves showing branding according to some inventive principles of this patent disclosure attached to two handles of the cooler.

FIG. 13 is another view showing the side of a typical currently available rotomolded cooler with embodiments of two beverage sleeves showing branding according to some inventive principles of this patent disclosure attached to two handles of the cooler.

FIG. 14 illustrates how a slit in the bottom of an embodiment of beverage sleeve may be streteched over the crossbar of the handle of a cooler according to some inventive principles of this patent disclosure.

Figure 15:
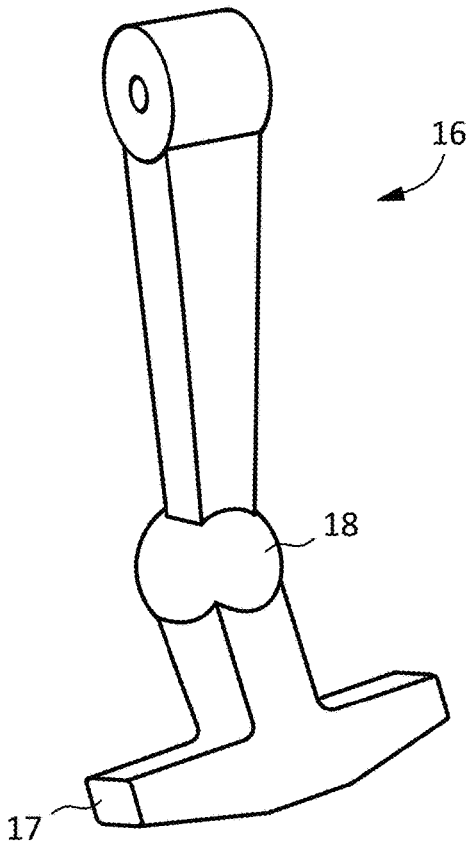
FIG. 15 illustrates a latch handle for a cooler.

FIG. 15 illustrates a T-shaped latch handle for a cooler. The latch handle 16 is typically made of rubber or other stretchable material and includes a crossbar 17 that enables a user to pull the handle downward, thereby stretching the handle to enable a ball portion 18 to engage one or more protrusions on the cooler.

Figure 16:
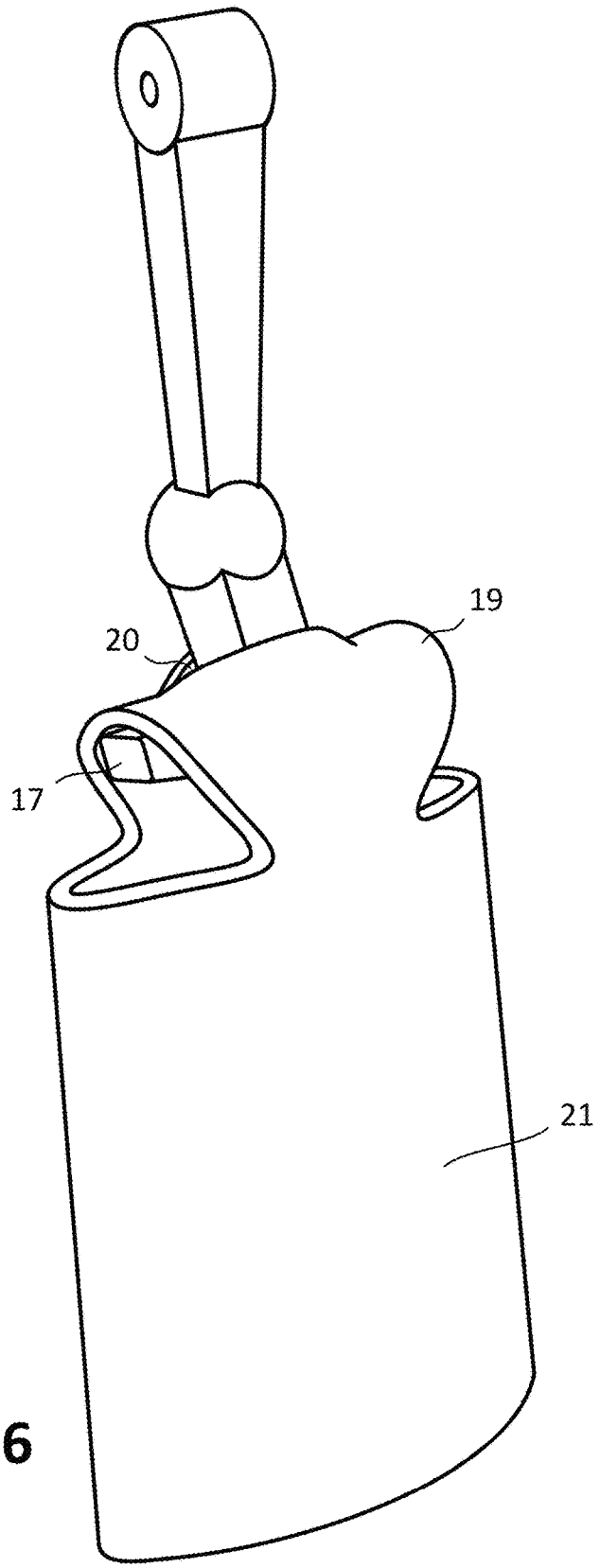
FIG. 16 illustrates an embodiment of beverage sleeve according to some inventive principles of this patent disclosure attached to the latch handle of FIG. 14.

FIG. 16 illustrates an embodiment of beverage sleeve according to some inventive principles of this patent disclosure attached to the latch handle of FIG. 14. In the view of FIG. 16, the slit 20 in the bottom portion 19 of the sleeve has been stretched over the crossbar 17 of the handle 16 such that the bottom portion 19 of the sleeve wraps around crossbar 17. In this position, the sleeve remains substantially flat and parallel to the crossbar 17 of the handle 16 such that a display area 21 is visible.

Although the embodiments described above utilize a slit to attach a beverage sleeve to a handle or other apparatus, other attachment apparatus may be used. This may include the use of fasteners such as buttons, hooks, magnets zippers, snaps, hook-and-loop fasteners to enlarge the opening for inserting the handle through the enlarged opening and then close it back around the handle or other apparatus, or to attach the sleeve directly to the handle or other apparatus.

Some additional aspects of the inventive principles may include an attachable thermally insulating beverage jacket comprising: a flexible body portion; a base portion; and a slit in the base portion. The flexible body portion may be made of thermally insulating material. The flexible body portion may be made of neoprene material. The slit may be reinforced and/or aligned with the sides of the insulating beverage jacket. The reinforced slit in the base portion may be reinforced by a strengthening material such as embroidery thread. The slit in the base portion may be adapted and arranged to attach to the handle of a typical currently available rotomolded cooler.

All illustrations of the drawings are for the purpose of describing selected versions of the present invention and are not intended to limit the scope of the inventive principles. The inventive principles are described in detail and provided in a manner that establishes a thorough understanding of the present invention. There may be aspects of the inventive principles that may be practiced without the simple mentation of some features as they are described. It should be understood that some details have not been described in detail in order to not unnecessarily obscure focus of the inventive principles.

Since the inventive principles of this patent disclosure can be modified in arrangement and detail without departing from the inventive concepts, such changes and modifications are considered to fall within the scope of the following claims.

The invention claimed is:

1. A method comprising:

insulating a beverage container with a beverage insulator; and attaching the beverage insulator to an apparatus when the beverage insulator is not in use;

wherein the beverage insulator consists essentially of:

a body; and an attachment mechanism;

wherein the body consists essentially of:

a first side panel and a second side panel adapted to wrap around the beverage container; and a bottom panel adapted to insulate the bottom of the beverage container;

wherein:

the first side panel is attached to the bottom panel along a first edge of the bottom panel;

the second side panel is attached to the bottom panel along a second edge of the bottom panel opposite the first edge;

the first and second side panels are adapted to remain substantially flat when attached to the apparatus; and the first side panel includes a display area;

wherein the attachment mechanism consists essentially of an opening through the bottom panel located proximate a center of the bottom panel;

wherein attaching the beverage insulator to the apparatus comprises inserting a portion of the apparatus through the opening through the bottom panel;

wherein the portion of the apparatus comprises a crossbar of a T-shaped handle;

wherein the bottom panel is adapted to wrap around the crossbar of the T-shaped handle when the beverage insulator is attached to the T-shaped handle; and wherein the first side panel remains substantially parallel to the crossbar when the beverage insulator is attached to a T-shaped handle such that the side panel is visible when viewing the apparatus; and wherein attaching the beverage insulator to the apparatus comprises:

inserting a first end of a crossbar of the T-shaped handle through the opening through the bottom panel;

pulling the beverage insulator to stretch the opening over a second end of the crossbar of the T-shaped handle; and releasing the beverage insulator to relax the opening around an upright of the T-shaped handle.

2. The method of claim 1 wherein the apparatus comprises a cooler.

3. The method of claim 1 wherein the opening through the bottom panel is a slit.

* * * * *